US006843305B2

(12) United States Patent
Lehman et al.

(10) Patent No.: US 6,843,305 B2
(45) Date of Patent: Jan. 18, 2005

(54) METHOD AND DEVICE FOR CONTROLLING STIRRING IN A STRAND

(75) Inventors: Anders Lehman, Bromma (SE); Per Larsson, Vasteras (SE)

(73) Assignee: ABB Group Services Center, AB, Vasteras (SE)

( * ) Notice: Subject to any disclaimer, the term of this patent is extended or adjusted under 35 U.S.C. 154(b) by 0 days.

(21) Appl. No.: 10/311,695

(22) PCT Filed: Apr. 7, 2001

(86) PCT No.: PCT/SE01/01531

§ 371 (c)(1),
(2), (4) Date: Feb. 12, 2003

(87) PCT Pub. No.: WO02/02831

PCT Pub. Date: Jan. 10, 2002

(65) Prior Publication Data

US 2003/0183363 A1 Oct. 2, 2003

(51) Int. Cl.[7] ..... B22D 11/115; B22D 27/02
(52) U.S. Cl. ..... 164/468; 164/504
(58) Field of Search ..... 164/466–468, 164/502–504

(56) References Cited

U.S. PATENT DOCUMENTS 4,957,156 A 9/1990 Mayrhofer 5,664,619 A * 9/1997 Andersson et al. ..... 164/502

FOREIGN PATENT DOCUMENTS

| | | |
|---|---|---|
| EP | 0 317 790 A1 | 5/1989 |
| JP | 4 274 846 A | 9/1992 |

* cited by examiner

*Primary Examiner*—Kuang Y. Lin
(74) *Attorney, Agent, or Firm*—Dykema Gossett PLLC

(57) ABSTRACT

A method of controlling the flow of molten metal in non-solidified portions of a strand (3) during continuous casting, and a device for application of the method. The device comprises a two-phase or plural-phase stirrer (1) arranged around a mould (6) that is open in opposite ends and that surrounds the strand (3), said stirrer (1) being arranged to generate a moving magnetic field in the melt, and at least one magnetic flow-conducting body (15) being placed between an inner periphery of said stirrer (1) and the outer periphery of the mould (6). In the case of open casting, the magnetic flow-conducting body (15) is positioned in a first position in which it displaces at least a part of the magnetic flow generated by the stirrer (1) in a direction towards the meniscus (17) of the strand (3), and, in the case of closed casting, the magnetic flow-conducting body (15) is positioned in a second position in which it displaces at least a part of the magnetic flow generated by the stirrer (1) away from the meniscus (17) of the strand (3).

19 Claims, 3 Drawing Sheets

METHOD AND DEVICE FOR CONTROLLING STIRRING IN A STRAND

TECHNICAL FIELD

The present invention relates to a method for controlling the stirring of melted metal in non-solidified portions of a strand during a continuous casting, by which the melt is affected by means of a two-phase or plural-phase stirrer arranged around a mould that is open in opposite ends and that surrounds the strand, and where at least one magnetic flow-conducting body is placed between an inner periphery of said stirrer and the outer periphery of the mould.

The invention also relates to a device for controlling the stirring of melted metal in non-solidified portions of a strand during continuous casting, comprising a two-phase or plural-phase stirrer arranged around a mould that is open in opposite ends and that surrounds the strand, the stirrer being arranged to generate a moving magnetic field in the melt, and at least one magnetic flux-conducting body being placed between an inner periphery of said stirrer and the outer periphery of the mould.

The term stirrer should be regarded in a wide meaning, but is primarily referred to as electro-magnetic stirrers that comprise one or more magnet cores around which windings, coils, are arranged for the purpose of generating a magnetic field in a melt located between these cores when the stirrer is subjected to an electric current. In the case of only one core, this core can be arranged as a toroid around the mould, while in the case of a plurality of cores, the latter can be connected via a common yoke made of a suitable material, for example iron.

Mould is referred to as all types of open moulds that are used in connection to continuous casting of metals, but particularly those that are used in connection with casting of slabs, blooms and billets, where the use of a stirrer is made in order to, amongst others, prohibit the growth of dendrites in a direction towards the centre of the strand as the melt in the latter solidifies.

THE BACKGROUND OF THE INVENTION

When a metal or metal alloy such as steel is cast in a mould that is open in both ends in the casting direction by means of a continuous or semi-continuous process, a melt is delivered to the mould as a free tapping jet (open casting) or via a casting tube (closed casting). As the melt passes through the mould a strand is formed by the cooled melt. Before the strand leaves the mould at least a self-supporting surface layer has been formed on the strand. An uncontrolled flow of metal in the non-solidified portions of the strand results in problems with regard to quality as well as the production itself.

The flow of melted metal in the non-solidified portions of a strand can be controlled by means of a two-phase or plural-phase stirrer by means of which a rotating magnetic field can be forced to act on the melt in these portions of the strand, as electric currents are induced in the melt. Thereby, due to a common effect of the magnetic field and the currents, stirring forces are created in the melt. A typical stirrer can be compared to the stator of an electric motor, where the melt forms the inner rotor. However, the losses are larger than by a conventional motor, partly depending on the gap that, for the majority of the stirrer constructions, is present between the cores and the melt.

In order to obtain the required string force, and accordingly satisfying metallurgical results, the movements of the melt must be controlled and distributed. Therefore, there are requirements on the properties and the distribution of the field strength of the magnetic field that is applied to the melt, as well as on the current intensity and the current density of the induced currents.

The requirements may differ between different casting processes, such as open and closed casting.

By closed casting, that is, when the melt is delivered to the mould through a casting tube that outlets in the melt below the so-called meniscus, there is required a stirring in the non-solidified portions, said sting being of enough strength to guarantee the requested metallurgical result as to the casting structure. However, stirring in the meniscus area should be avoided because such stirring could result in slag and casting powder on the meniscus surface being pulled down into the melt and then generating inclusions therein as the melt solidifies.

By open casting, that is, when melt is delivered to the mould from a container or a box or the like, as a free jet, it is required that the flow velocity at the meniscus is sufficiently high in order to obtain the requested metallurgical results. A sufficiently strong flow at the meniscus is obtained by giving the applied magnetic flew-flux a sufficiently high strength at the meniscus.

PRIOR ART

In order to achieve the requirements mentioned above with regard to the magnetic flew flux at the meniscus during open as well as closed casting, the magnetic field should be moved from a first position close to the meniscus during open casting to a position further away, below the meniscus during closed casting. The document DE 38 19 493 describes a device for continuous casting by which this problem has been solved by having the stirrer, with existing coils and cores, movably arranged in the casting direction along an inner mould. However, in reality, such a solution is complicated and will require a large space for the stirrer. DE 28 53 049 discloses how the magnetic flew-flux from a linear motor stirrer is amplified as magnetic teeth are arranged between the stirrer coils and the strand. The teeth are removably arranged and, for example, made of transformer sheet. However, this document does not mention how the field can be directed upwards or downwards such that the stirrer can be located at the same level for both open and closed casting.

THE OBJECTION OF THE INVENTION

The object of the present invention is to propose a method and a device for controlling the stirring of melted metal in non-solidified parts of a strand during continuous casting by means of a rotating magnetic field, said magnetic field being displaceable in a direction towards or from the meniscus of the strand depending on if an open or closed casting is applied. At the same time, the invention shall permit the energy losses of the stirrer to be kept at a minimum, as an existing gap with poor magnetic flow-conducting properties between the coils of the stirrer and the melt is minimised.

SUMMARY OF THE INVENTION

The object of the invention is attained by means of the initially defined method, characterised in that, in the case of open casting, the magnetic flux-conducting body is positioned in order to displace at least a part of the magnetic flux generated by the stirrer in a direction towards the meniscus of the strand, and that, in the case of closed casting, the magnetic flew flux-conducting body is positioned in order to displace at least a part of the magnetic flux generated by the stirrer away from the meniscus of strand. In normal cases, the mould is arranged generally vertically. Therefore, the magnetic flux-conducting body is positioned closer to the top of the mould during open casting and further downwards, away from the top, during closed casting.

It should be realised that a plurality of magnetic flew flux-conducting bodies can be positioned around the mould in the way mentioned above. Preferably, a respective body is positioned generally opposite to, that is, radially inside, a respective pole in order to define an extension of said pole in a direction towards the mould. However, there is nothing that prohibits said body from extending axially in the casting direction beyond the corresponding pole of the stirrer, that is, that the body is at least partly on a higher or lower level than the cores and coils of the stirrer. In that way, the magnetic field is directed towards a region in which it would only have been present to a small degree in absence of the supplementing magnetic flux-conducting body or bodies.

A preferred embodiment of the method is characterised in that the magnetic flux-conducting body is arranged to conduct a major part of the magnetic flux generated by the stirrer. Thereby, it is preferred that the magnetic flux-conducting body is dimensioned in such a way and made of such a material that generally the whole magnetic field generated by the stirrer is conducted into the melt via said body without super-saturation thereof.

In the case in which the mould is surrounded by an outer mantle which, between itself and the outer periphery of the mould defines one or more cooling channels, the magnetic flew flux-conducting body is preferably positioned between the outer periphery of the mould and this outer mantle. In the casting of billets, blooms and slabs the present trend is to use moulds where the copper mould is surrounded by such an outer mantle and where the mould and the mantle together form a cassette which can be brought into and out of the surrounding stirrer in one piece, for example when new dimensions are to be cast or by a change from closed to open casting. The invention includes solutions in which the magnetic flux-conducting bodies are positioned at different levels in different cassettes, with regard to the application of open or closed casting, or where the body/bodies is/are movably arranged in a cassette in order to be able to positioned depending on the casting case in question. Thereby, the method according to the invention promotes an effective utilisation of existing space between mould and stirrer while, simultaneously, the advantages of cassette solutions are permitted.

The object of the invention is also achieved with a device of the initially defined type, characterised in that, in the case of open casting, the magnetic flux-conducting body is positioned in a first position in which it displaces at least a part of the magnetic flux generated by the stirrer in a direction towards the meniscus of the strand, and that, in the case of closed casting, the magnetic flux-conducting body is positioned in a second position in which it displaces at least a part of the magnetic flux-generated by the stirrer way from the meniscus of the strand.

Preferably, the magnetic flux_conducting body is arranged to conduct major part of the magnetic flux generated by the stirrer to the melt. As has been previously mentioned, the magnetic flew-flux-conducting body is preferably dimensioned in such a way and made of such a material that generally the whole magnetic field generated by the stirrer is conducted into the melt via said body without any super-saturation thereof, or in any of a plurality of such bodies. One way of achieving this is to make use of a plurality of rod-formed or plate-formed magnetic field flux-conducting bodies of a suitable material and of a suitable size, aid bodies being positioned between the respective poles of the stirrer and the mould. Preferably, the number of bodies corresponds to the number of poles of the stirrer, the number thereby being twice the number of phases as there is needed two poles for each phase in a plural-phase stirrer. The bodies may, preferably, be elongated and extend in the casting direction.

According to one embodiment, the mould is surrounded by an outer mantle which between itself and the outer surface of the mould defines one more cooling channels, the magnetic flux-conducting body being positioned between the outer periphery of the mould and the outer mantle. A cooling medium, preferably water, fills the space between the mantle and the mould. The magnetic flux conducting body (or bodies) is (are) preferably mainly made of iron, but may, advantageously, contain corrosion strength-increasing alloy elements or be provided with a layer or any corrosion resistant material in order to prevent the from corroding due to the effect of the cooling medium.

In reality, the mould is often surrounded by a supporting sheet, and the magnetic flew flux-conducting body is then, according to one embodiment, fixed to the support sheet. According to an alternative embodiment, the magnetic flux-conducting body or bodies) is (are) fixed to the outer mantle, more precisely the inner periphery thereof.

Further advantages and features of the invention will be disclosed in the following detailed description and in the enclosed dependent patent claims.

BRIEF DESCRIPTION OF THE DRAWINGS

Hereinafter, the invention will be described more in detail with reference to the embodiments that are shown on the annexed drawings, on which.

DETAILED DESCRIPTION OF THE INVENTION

Figure 1:
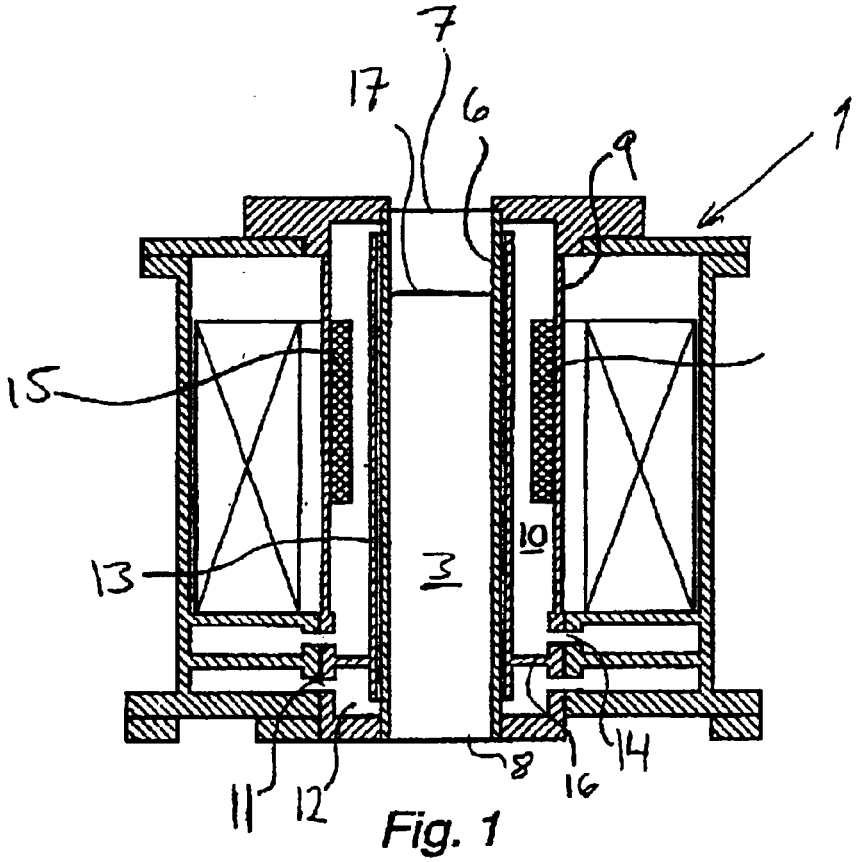
FIG. 1 is a schematic cross-section from one side of a first embodiment of the device according to the invention, with magnetic flux-conducting bodies in a first position.
Figure 2:
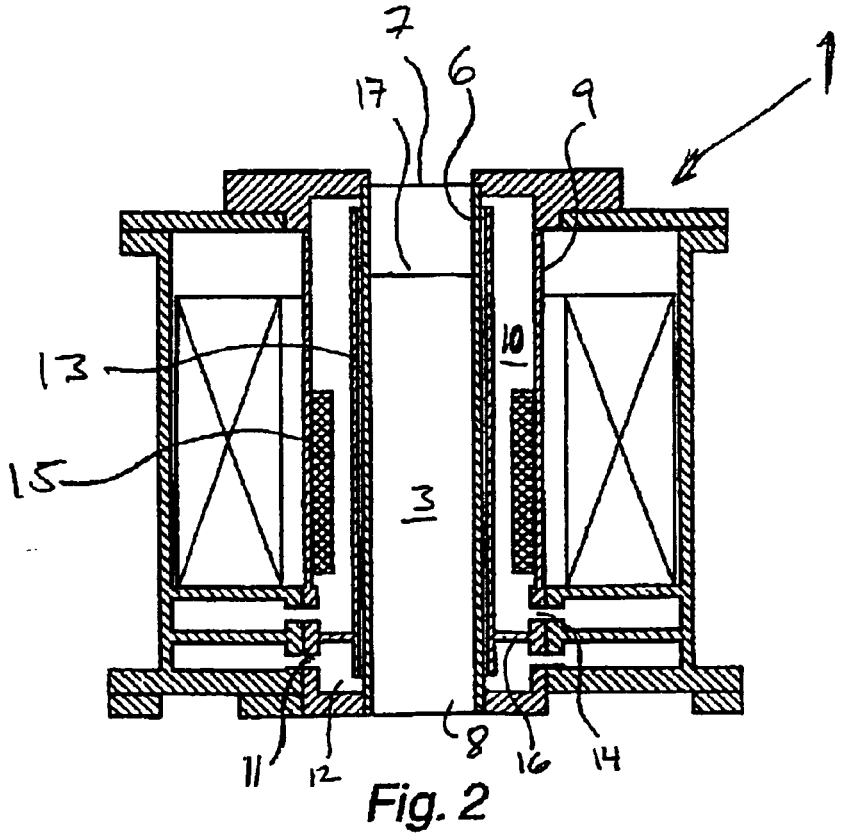
FIG. 2 is a cross-section corresponding to the one in FIG. 1, but with the magnetic flux-conducting bodies in a second position.

FIGS. 1 and 2 show a first embodiment of a device according to the invention, intended for continuous casting of metals, particularly steel. FIG. 1 shows the device in a first position, adjusted for open casting, that is, casting with a free tapping jet, while FIG. 2 shows the device in a second position, adjusted for closed casting, that is, casting by means of a casting tube.

Figure 4:
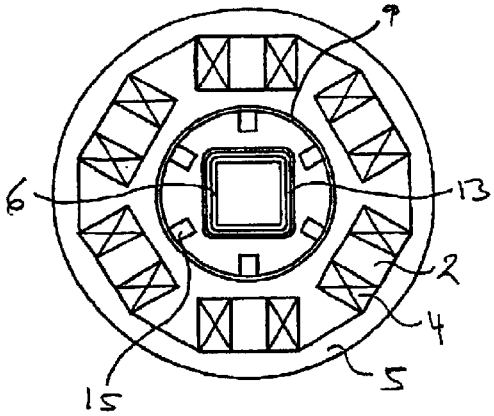
FIG. 4 is a cross-section according to IV—IV in FIG. 3.

The device comprises an electromagnetic stirrer 1 that comprises a plurality of cores 2, as shown in FIG. 4. Coils 4 of electric conductors are wound around the cores. In the shown embodiment the device comprises three pairs of poles in a way known per se, and these poles are fed with a three-phase alternating current in a way known per se. Alternative solutions may, for example, comprise two pairs of poles which are fed with two-phase alternating current. The cores 2 are interconnected by a yoke 5. Preferably, the cores and the yoke are substantially made of iron. The alternating current frequency is low, for example in the range of 1–20 Hz.

As an alternative, the device may comprise only one iron core, arranged as a toroid that extends around the mould and on which a corresponding number of coils are wound in a way known per se.

The stirrer 1 is arranged around a mould tube or a mould 5 that suitably comprises copper as its major constituent, said mould being arranged for generally vertical casting and presenting an upper opening 7, through which melt is delivered to the mould, and a lower opening 8, through which a strand 3 is continuously taken out from the mould 6 during casting.

Figure 5:
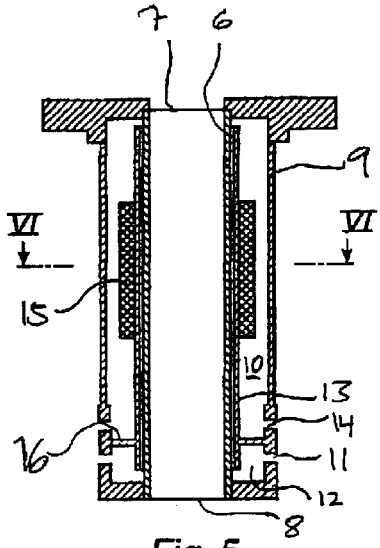
FIG. 5 is a cross-section corresponding to the one in FIG. 3, but showing a second embodiment of the device according to the invention.

In the embodiments shown in FIGS. 1–6 the device comprises a cassette that comprises the copper mould and an outer mantle 9 that is arranged outside and with a distance to the mould. A space 10 between the mould 6 and the mantle 9 defines a cooling channel. FIG. 5 shows that the mantle 9 comprises an inlet hole 11, via which a cooling medium, preferably water, is introduced inside the mantle 9 in a separate lower space 12 in order to subsequently being brought to flow along the outer periphery of the mould 6 upwards and thereby cooling the latter. A support sheet 13, suitably made of stainless steel, is arranged most adjacent outside the mould 6, and the cooling medium is flowing from the lower space in a gap between the mould 6 and the support sheet 13 upwards as seen in the figure. At the upper end of the support sheet 13 the gap opens in the space 10, and flows through the latter downwards and out of said changer via an outlet opening 14 in the lower part of the mantle 9, just above a transverse wall 16 that separates the space 10 from the lower space 12. It should be realised that, of course, a plurality of alternatives to this solution are within the scope of the invention and that this solution is only shown by way of example. For example, it is fully possible to arrange an inlet, an outlet and a transverse wall that correspond to the inlet 11, the outlet 14 and the transverse wall 16, in the upper part of the mould, which, in reality, also is often the case. The mantle 9 and the support sheet 13 must, however, be made of non-magnetic material.

Between the stirrer 1 and the mould 6 there is arranged a plurality of bodies 15 of a magnetic flux-conducting material, preferably iron. The number of magnetic flux-conducting bodies corresponds to the number of poles of the stirrer 1, in this case six. Each of the bodies 15 is arranged adjacent a respective pole, radially inside the latter, in order to improve the magnetic conductivity between the pole in question and the strand 3 located inside the mould. In FIG. 1, the bodies 15 are positioned in an upper position in which they direct the magnetic field from the stirrer upwards towards the region of the meniscus 17 of the strand. Thereby, the bodies 15 are displaced towards or even partly beyond an upper part or upper half of the axial region over which the poles of the stirrer 1 extend. Thereby, it will be possible to direct the magnetic field generated by the stirrer 1 towards the meniscus area also in the case when the meniscus is located at a higher level than the stirrer, thanks to a displacement of the position of the bodies 15 upwards towards the meniscus 17.

FIG. 2 shows the case in which the bodies 15 are displaced towards or even partly beyond a lower part or a lower half of the region over which the poles of the stirrer 1 extend. Thereby, the magnetic field generated by the stirrer 1 is directed away from, downwards from the meniscus area. Preferably, the bodies 15 are positioned in this second position during closed casting, when it is required to avoid a strong magnetic field at the meniscus 17.

Figure 3:
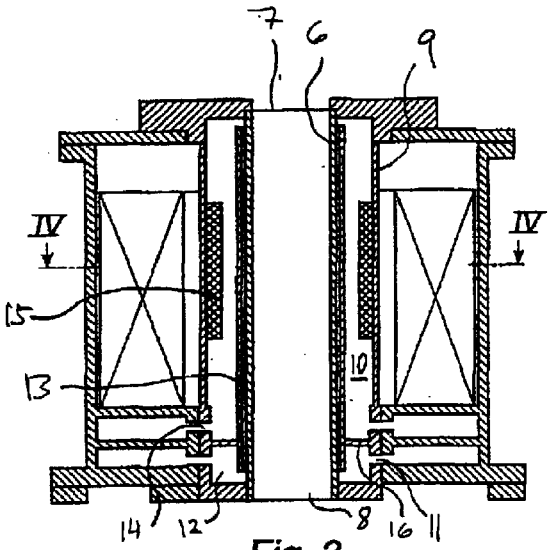
FIG. 3 shows a cross-section from one side that shows a device according to a first embodiment, corresponding to the one in FIGS. 1 and 2.

FIGS. 3 and 4 show an embodiment in which the bodies are fastened to the inside of the outer mantle 9, and thereby placed in the space 10 between the mantle 9 and the mould 6. Thereby, a part of the cooling channel space is used in order to make place for the bodies 15, and this is advantageous from a space-serving point of view. Thereby, the bodies 15 form a part of the above-mentioned cassette.

Figure 6:
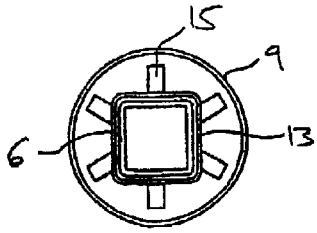
FIG. 6 is a cross-section according to VI—VI in FIG. 5.

FIGS. 5 and 6 show an alternative embodiment of a cassette by which the bodies 15 are fastened to a support sheet 13 that surrounds the copper mould 6. However, the principle is the same, namely to arrange the bodies 15 in the cooling channel space between the stirrer 1 and the mould 6 in order to take advantage of the space that in any case will be provided by the cassette, in order to reduce field strength losses and, at the same time, direct the magnetic field.

FIGS. 1–6 show examples of mould housings with externally located stirrers 1, that is, a cassette that comprises the mould 6 and the outer mantle 9 which is separately removable from the rest of the stirrer 1. In this case, the removal is performed by lifting the cassette vertically upwards out of the stirrer 1.

Figure 7:
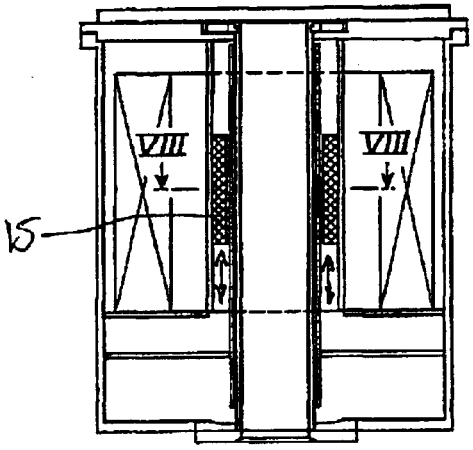
FIG. 7 is a cross-section corresponding to the one in FIGS. 3 and 5, but showing a third embodiment of the device according to the invention.
Figure 9:
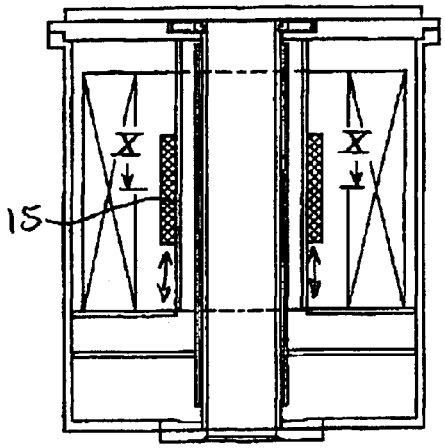
FIG. 9 is a cross-section corresponding to the ones in FIGS. 3, 5 and 7, but showing a fourth embodiment of the device according to the invention.
Figure 8:
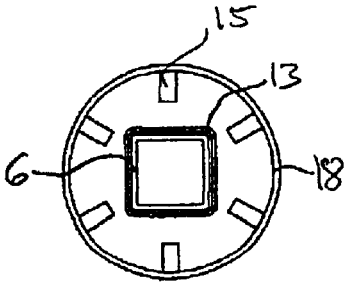
FIG. 8 is a cross-section according to VIII—VIII in FIG. 7.
Figure 10:
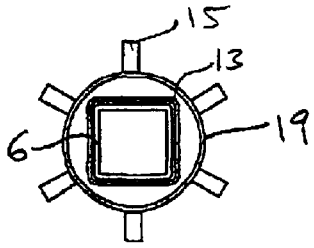
FIG. 10 is a cross-section according to X—X in FIG. 9.

FIGS. 7–10 show examples of a mould housing with internally located stirrers, that is, that it is not possible to distinguish any well-defined cassette that is removable from the stirrer. Instead, stirrer and mould form one single unit. In such a case, when a cassette with a given positioning of the bodies 15 cannot simply be substituted to the cassette with another positioning of the bodies 15, for example in connection with the transfer from open to closed casting, the importance of having the bodies 15 displaceable or movable between the above-mentioned first and second positions increases. This can be obtained as the bodies are displaceably arranged in the casting direction along the outside of the mould 6 or, as shown in FIGS. 7 and 8, the outside of the outer mantle 18. Alternatively, they are displaceably arranged along the inside of an outer mantle 9, such as shown in FIGS. 9 and 10. The mantles 18, 19 correspond to the above-described mantle 9 as they are arranged in contemporary conventional mould housings with included stirrers.

With regard to the above disclosure of the invention it should be realised that a plurality of further, alternative embodiments of course will be obvious to a man skilled in the art, however without going beyond the scope of the invention as the latter is defined in the enclosed patent claims supported by the description and the annexed drawings.

For example, within the scope of the invention, it is also possible to present alternative embodiments of the magnetic flux-conducting bodies 15, and to divide separate bodies into a plurality of sub-bodies, etc. As one or more bodies 15 are divided into sub-bodies or segments one or more of those sub-bodies should be removably arranged in order to enable a redirection of the magnetic field during ongoing casting or between different casting processes.

The above examples have shown stirrers with three-phase, two-pole coupling, resulting in the application of six bodies or pole plates 15. However, it should be realised that also other constructions are possible. For example, stirrers with two-phase, two-pole couplings are often used, resulting in the use of four bodies or pole plates, one at each pole.

It is also conceivable that the poles of the stirrers are arranged at different levels along the mould, and that this, in its turn, results in the possibility of arranging the bodies/pole plates 15 at mutually different levels.

The bodies 15 are preferably laminated, that is, constructed as laminate structures. However, they may be made of homogenous iron, but will then operate less well.

What is claimed is:

1. A method for controlling a stirring of molten metal in non-solidified portions of a strand during continuous casting, comprising the steps of:

providing a two-phase or plural-phase stirrer arranged around a mould that is open at opposite ends and that surrounds the strand, and placing at least one magnetic flux-conducting body between an inner periphery of said stirrer and the outer periphery of said mould, positioning, in case of open casting, the magnetic flux-conducting body in order to displace at least a part of the magnetic flux generated by the stirrer in a direct on towards the meniscus of the strand, and positioning, in the case of closed casting, the magnetic flux-conducting body in order to displace at least a part of the magnetic flux generated by the stirrer a ay from the meniscus of the strand.

2. A method according to claim 1, further comprising the step of arranging the magnetic flux-conducting body to conduct a major part of the magnet flew flux generated by the stirrer.

3. A method according to claim 1, further comprising the steps of:

dimensioning the magnetic flux-conducting body in such a way and forming it of such a material that generally the whole magnetic field generated by the stirrer is conducted into the melt via said body without any supersaturation of said body.

4. A method according to claim 1, comprising the steps of:

positioning the mould vertically with an upper and lower opening respectively, and displacing the magnetic field upwards along the mould in the case of open casting and downwards in the case of closed casting.

5. A method according to claim 1, comprising he steps of:

surrounding the mould by an outer mantle that, between itself and the outer periphery of the mould, defines one or more cooling channels, and positioning the magnetic flow-conducting body between the outer periphery of the mould and the outer mantle.

6. A method according to claim 1, comprising the steps of:

surrounding the mould by a support sheet and fastening the magnetic flux-conducting body to the support sheet.

7. A method according to claim 5, comprising the step of:

fastening the magnetic flux-conducting body to the outer mantle.

8. A device for controlling the stirring of molten metal in non-solidified portions of a strand during continuous casting, comprising:

a two-phase or plural-phase stirrer arranged around a mould said stirrer being open in opposite ends and surrounding the strand, said stirrer being arranged to generate a moving magnetic field in the melt, and at least one magnetic flux-conducting body, located between an inner periphery of said stirrer and the outer periphery of the mould, wherein in the case of open casting, the magnetic flux-conducting body is in a first position proximate to the menicus such that it displaces at least a part of the magnetic flux generated by the stirrer in a direction towards the meniscus of the strand, and, in the case of closed casting, the magnetic flux-conducting body is positioned in a second position proximate to the melt and remote from the meniscus in which it is displaced at least a part of the magnetic flux generated by the stirrer away from the meniscus of the strand.

9. A device according to claim 8, wherein when the magnetic flux-conducting body is arranged to conduct positioned proximate to the melt major part of the magnetic flux generated by the stirrer is conducted by the body to the melt.

10. A device according to claim 8, wherein the magnetic flux-conducting body is dimensioned in such a way and is formed of a material the generally, the whole magnetic field generated by the stirrer is conducted into the melt via said body without any supersaturation of said body.

11. A device according to claim 8, wherein the mould is surrounded by an outer mantle which, between itself and the outer periphery of the mould, defines one or more cooling channels, and the magnetic flux-conducting body is positioned between the outer periphery of the mould and the outer mantle.

12. A device according to claim 8, wherein the mould is surrounded by a support sheet and the magnetic flux-conducting body is fastened to the support sheet.

13. A device according to claim 11, wherein the magnetic flux-conducting body is fastened to the outer mantle.

14. A device according to claim 8, wherein the mould is arranged generally vertically with an upper and a lower opening for continuous casting in a vertical direction, and the magnetic flux-conducting body is arranged at an upper region of the mould adjacent the meniscus during open casting, and at a lower region of the mould remote from the meniscus during closed casting.

15. A device according to claim 8, further comprising one or more pole pairs arranged around the mould, and the at least one magnetic field flux-conducting body is arranged between at least one of the poles of the pole pair and the mould.

16. A device according to claim 8, further comprising one or more pole pairs arranged around the mould, and the at least one magnetic field flux-conducting body is arranged between the pair of poles and the mould.

17. A device according to claim 8, wherein the least one magnetic flux-conducting body has the shape of a rod or a plate that extends in the longitudinal direction of the mould.

18. A device according to claim 8, wherein the stirrer and the mould are in spaced relation, the at least one magnetic flux-conducting body being located in the space and being sized in order to permit movement of the at least one magnetic flux-conducting body from the first to the second position and from the second to the first position in the space without removing of the mould from the stirrer.

19. A device according to claim 18, wherein the a least one magnetic flux-conducting body is displaceably arranged between the first and the second position.

* * * * *